US006394541B1

(12) United States Patent
Wegner

(10) Patent No.: US 6,394,541 B1
(45) **Date of Patent: *May 28, 2002**

(54) FOLDING CHAIR

(76) Inventor: Christopher C. Wegner, 3764 N. 450 W., Winamac, IN (US) 46996

( * ) Notice: Subject to any disclaimer, the term of this patent is extended or adjusted under 35 U.S.C. 154(b) by 0 days.

This patent is subject to a terminal disclaimer.

(21) Appl. No.: 09/625,704

(22) Filed: Jul. 25, 2000

Related U.S. Application Data

(63) Continuation of application No. 09/236,945, filed on Jan. 25, 1999, now Pat. No. 6,106,056.

(51) Int. Cl.[7] ..... A47C 4/00

(52) U.S. Cl. ..... 297/16.1; 297/21; 297/22; 297/48; 297/452.13

(58) Field of Search ..... 297/16.1, 21, 22, 297/24, 25, 46, 48, 56, 59, 452.13, 452.2

(56) References Cited

U.S. PATENT DOCUMENTS

| | | | | |
|---|---|---|---|---|
| 571,823 A | * 11/1896 | Briggs | 297/21 |
| 1,913,651 A | * 6/1933 | Yamaoka | 297/22 |
| 2,704,569 A | * 3/1955 | Salzer | 297/21 X |
| 3,123,396 A | * 3/1964 | Searle | 297/21 X |
| 5,476,308 A | * 12/1995 | St. Germain | 297/452.13 X |

FOREIGN PATENT DOCUMENTS

| | | | |
|---|---|---|---|
| GB | 24850 | * 11/1907 | 297/48 |

* cited by examiner

*Primary Examiner*—Laurie K. Cranmer
(74) *Attorney, Agent, or Firm*—Woodard, Emhardt, Naughton, Moriarty & McNett

(57) ABSTRACT

A chair comprises a first leg frame having opposing left and right side rails and at least one cross rail extending therebetween, the side rails each having upper and lower ends; a second leg frame having opposing left and right side rails and a front cross rail extending therebetween, the side rails each having upper and lower ends; a back frame having opposing left and right side rails and a top cross rail extending therebetween, the side rails each having upper and lower ends; left and right frame links each having upper and lower ends; a flexible support member extending between the top cross member and the front cross member; and, wherein the left and right side rails of the first frame are pivotally connected along a first pivot axis to the respective left and right side rails of the back frame are pivotally connected along a second pivot axis to the respective left and right side rails of the second frame, and wherein the left and right frame links are pivotally connected along a third pivot axis to the respective left and right side rails of the back frame and are pivotally connected along a fourth pivot axis to the respective left and right side rails of the second frame.

1 Claim, 9 Drawing Sheets

FOLDING CHAIR

REFERENCE TO RELATED APPLICATIONS

This is a continuation of my prior application, Ser. No. 09/236,945 filed on Jan. 25, 1999 now U.S. Pat. No. 6,106,056.

FIELD OF THE INVENTION

The present invention relates the field of furniture, and more particularly to folding and portable chairs and the like.

BACKGROUND OF THE INVENTION

Chairs constructed of hinged or similar construction enabling them to be folded and easily carried from one place to another, and enabling them to be conveniently stored, have long been known. Examples of portable and/or folding chairs are shown in the following U.S. Patents:

| U.S. Pat. No. | Inventor |
|---|---|
| 4,836,601 | Richard E. Cone |
| 4,824,167 | King |
| 4,671,566 | Knapp et al. |
| 4,595,232 | Glenn et al. |
| 4,533,174 | Fleishman |
| 4,390,204 | Fleishman |
| 3,453,022 | Lecuyer |
| 2,074,998 | Kaufman |
| 2,052,955 | Vanderminden |
| 1,969,313 | Meeker |
| 1,949,282 | Murray |
| 1,443,734 | Craig |
| 780,009 | Mettler |
| 780,007 | Mettler |
| 780,006 | Mettler |
| 487,553 | Cole |
| 233,732 | Cotton |
| 220,949 | Wakefield |
| 173,054 | Philips |

However, each of the chairs of the prior art suffers from one or more inherent disadvantage. For example, one of the most common portable, folding chairs is the type made of aluminum tubing sections that are pivotally interconnected to define a sturdy seat, back and arm/armrest combination that is easily foldable from a substantially flat storage condition to an erected sitting condition. The arm rests of such chairs are typically a structural necessity and are desired by most people for comfort. However, some find the arm rest structures constraining. For example, persons of large girth may find it particularly difficult or uncomfortable to sit in, and to get in and out of, chairs where the chair arms define a relatively narrow passage. The chair arms of such portable, folding chairs may also present an undesirable obstruction for persons engaged in a particular activity while sitting, such as guitar playing, fishing, etc.

Such chairs also typically comprise a frame with a textile or synthetic material that, once torn or damaged, cannot easily be replaced or, if it were replaced, would not be cost effective to do so.

What is needed is an improved folding, portable and lightweight chair that permits unrestricted use by large and small persons alike and which offers as little obstruction as possible from activity while seated in the chair.

SUMMARY OF THE INVENTION

Generally speaking there is provided a portable chair that may be folded between a substantially flat storage and transport condition and an unfolded, erected condition which includes a seat and a back but which does not included arms.

In one embodiment, a chair comprises a first leg frame having opposing left and right side rails and at least one cross rail extending therebetween, the side rails each having upper and lower ends; a second leg frame having opposing left and right side rails and a front cross rail extending therebetween, the side rails each having upper and lower ends; a back frame having opposing left and right side rails and a top cross rail extending therebetween, the side rails each having upper and lower ends; left and right frame links each having upper and lower ends; a flexible support member extending between the top cross member and the front cross member; and, wherein the left and right side rails of the first frame are pivotally connected along a first pivot axis to the respective left and right side rails of the back frame and are pivotally connected along a second pivot axis to the respective left and right side rails of the second frame, and wherein the left and right frame links are pivotally connected along a third pivot axis to the respective left and right side rails of the back frame and are pivotally connected along a fourth pivot axis to the respective left and right side rails of the second frame.

It is an object of the present invention to provide an improved folding, portable chair.

It is another object of the present invention to provide an improved folding, portable chair that has no arm members that maintains a high degree of strength and stability.

Other objects and advantages of the present invention will become apparent from the following description of the preferred embodiment.

DESCRIPTION OF THE PREFERRED EMBODIMENT

Figure 1:
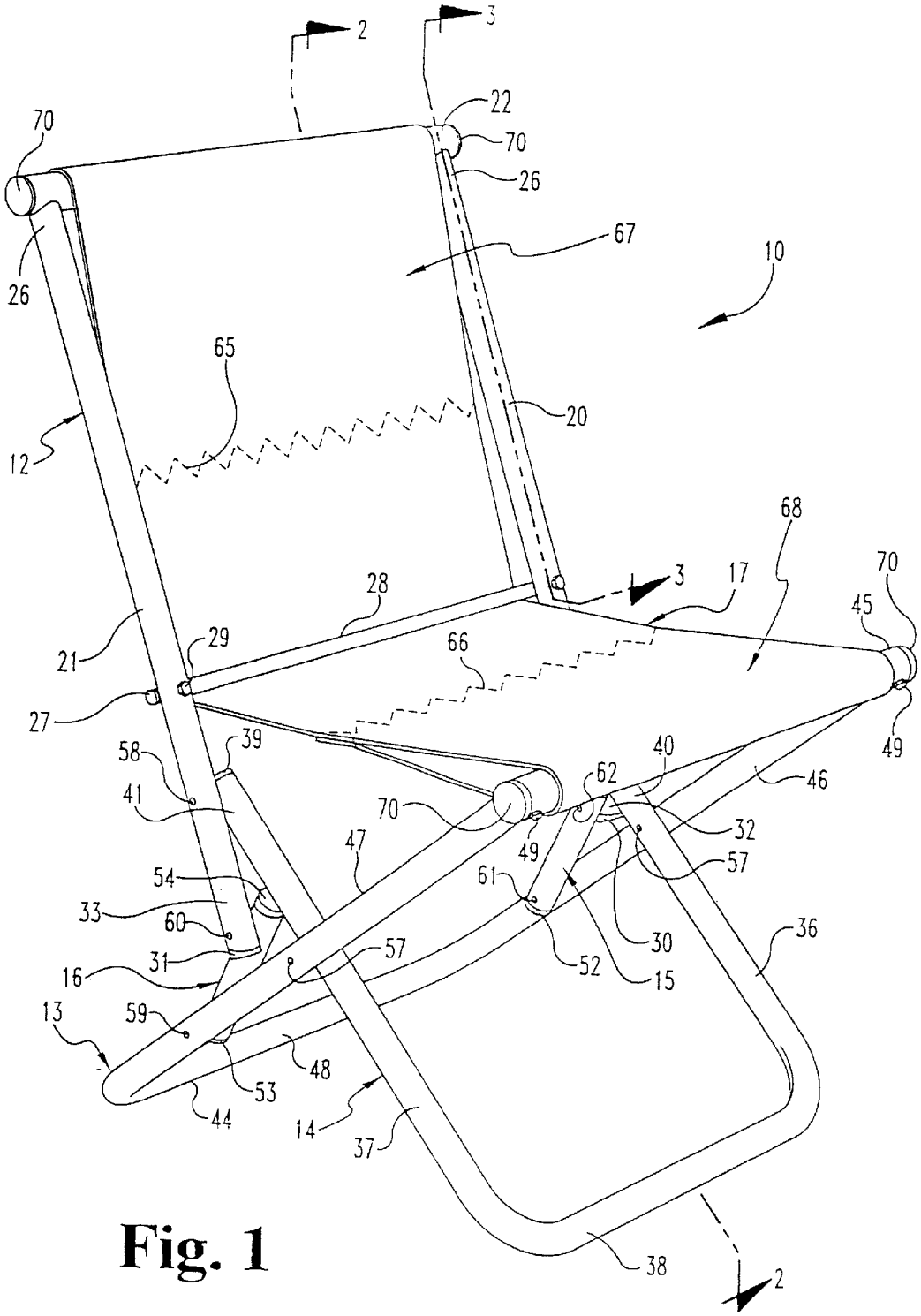
FIG. 1 is a perspective view of the folding chair 10 in accordance with the preferred embodiment of the present invention, and shown in the erected, rest position.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 2:
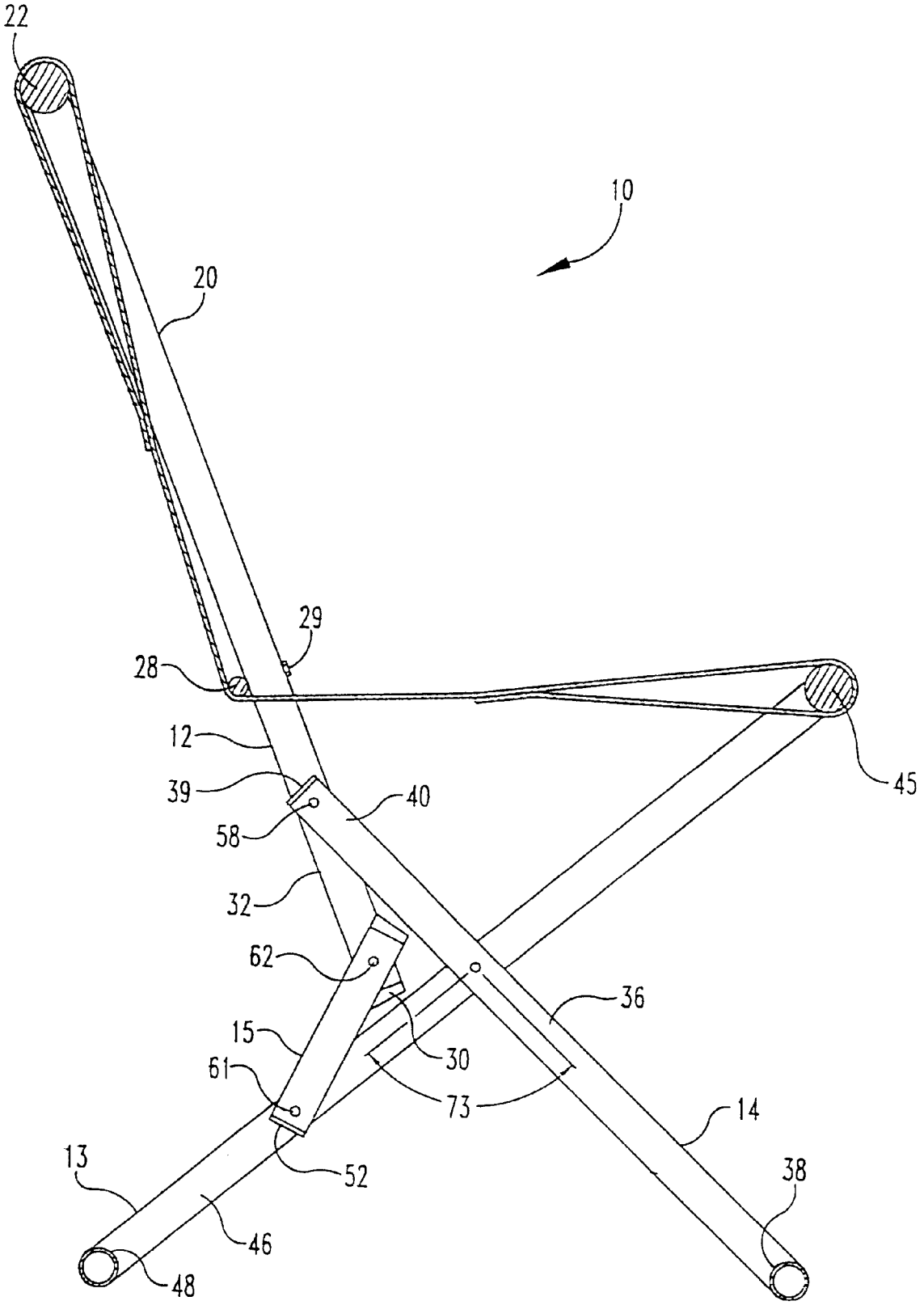
FIG. 2 is a side cross sectional view of the folding chair 10 of FIG. 1, taken along the lines 2—2 and viewed in the direction of the arrows.
Figure 3:
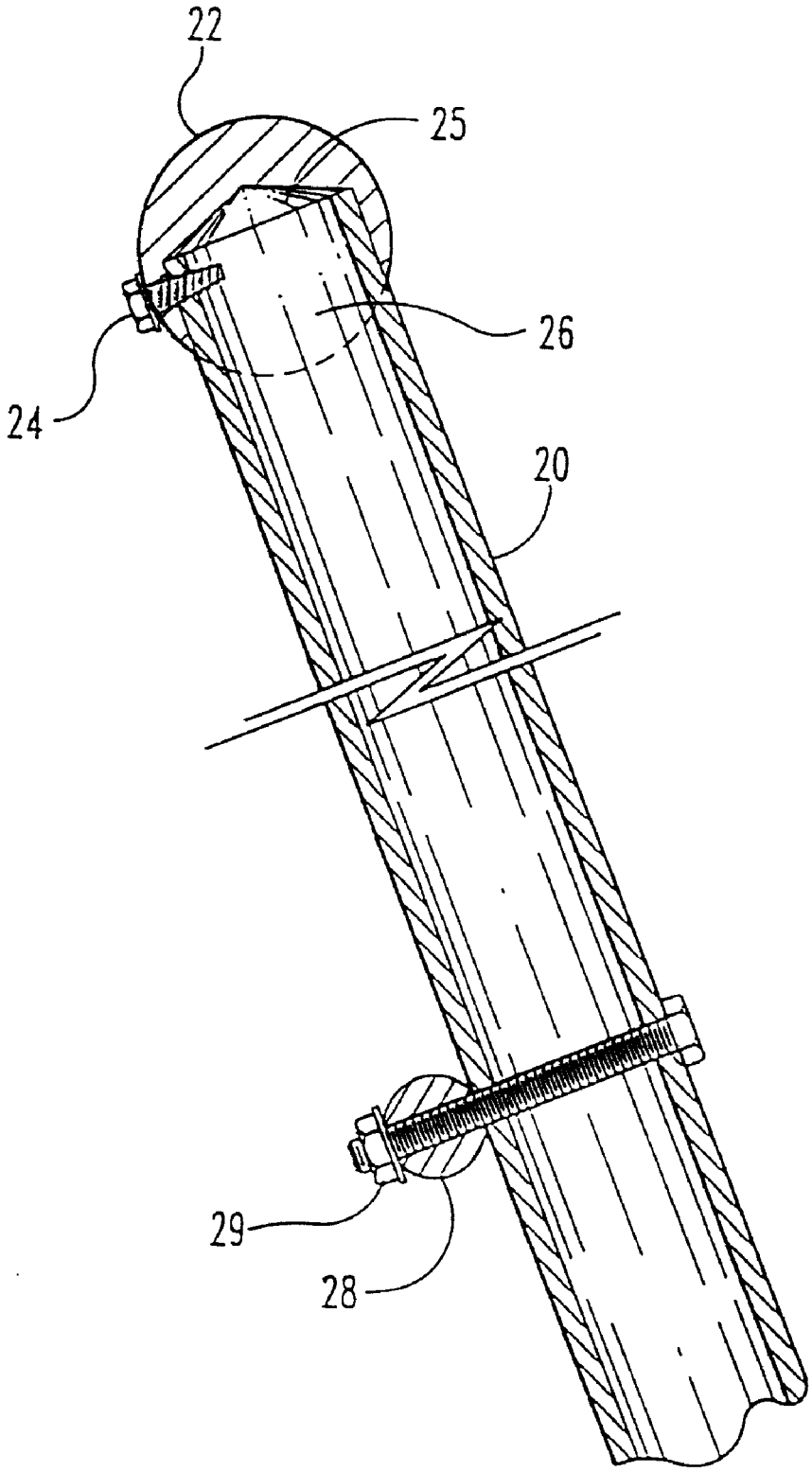
FIG. 3 is a side cross sectional view of a portion of the folding chair 10 of FIG. 1, taken along the lines 3—3 and viewed in the direction of the arrows.

Referring now to FIGS. 1–3, there is shown a folding chair 10 in accordance with the preferred embodiment of the present invention. Chair 10 generally includes back frame 12, first leg frame 13, second leg frame 14, left frame link 15, right frame link 16, and flexible support 17. Frames 12, 13, and 14 and links 15 and 16 are each made of a material which provides an optimal balance among strength, weight, and cost. It is believed that aluminum tubing achieves this optimal balance, but other materials and shapes are also contemplated.

Back frame 12 has a generally U-shaped configuration consisting of left and right hollow tubing side rails 20 and 21, respectively, and a top cross rail 22. In one embodiment top cross rail 22 is solid, has a round cross section, and defines a pair of recesses 25 at each end (one shown in FIG. 3) that are shaped and sized to receive the complimentary-shaped upper rail portions 26 of the corresponding side rails 20 and 21. A screw 24 extends through aligned holes in top cross rail 22 and the corresponding side rails 20 and 21 to firmly lock cross rail 22 to each side rail 20 and 21. In the alternative, cross rail 22 may be of hollow tubing or may be of other suitable shape and size as is well known in the art. Cross rail 22 may also be secured to the front or back sides of side rails 20 and 21 by appropriate fasteners. Alternatively, side rails 20 and 21 may be of a particular shape to receive and be secured to a complementary-shaped cross rail 22.

A cross bar 28 spans left and right side rails 20 and 21 and is fastened to the back side of and slightly more than half way down along rails 20 and 21 and is secured thereto by appropriate fasteners such as a bolt, lockwasher, and nut combination 29. Protective end caps 27 are provided at the opposing outer ends of cross bar 28. End caps 30 and 31 are provided at the ends of lower rail portions 32 and 33 of side rails 20 and 21, respectively. End caps 30 and 31 are made of any appropriate material which provides some cushioning to the contact between rails 20 and 21 and first leg frame 13. It is preferred that end caps 30 and 31 be comprised of an appropriate rubber or plastic.

Second leg frame 14 is tubular with a U-shaped configuration having left and right side rails 36 and 37, respectively, and bottom cross rail 38 extending therebetween. Protective end caps are provided at the ends of upper portions 40 and 41 of side rails 36 and 37.

First leg frame 13 has a generally rectangular box-shaped configuration and comprises a U-shaped tubular frame 44 and a front cross rail 45. U-shaped tubular frame 44 is similar to second leg frame 14 and has left and right side rails 46 and 47, respectively, and bottom cross rail 48 extending therebetween. Front cross rail 45 is substantially identical to top cross rail 22 and is rigidly connected to the upper ends of side rails 46 and 47 by screws 49 in a manner that is substantially identical to the way top cross rail 22 is secured to left and right side rails 20 and 21. As with top cross rail 22, front cross rail 45 may be of alternative shape and configuration so long as it creates, along with left and right side rails 46 and 47, a strong and stable frame for tautly supporting flexible support 17.

Left and right frame links 15 and 16 are also tubular and are provided with lower protective end caps 52 and 53 and upper end caps 54 and 55, respectively. Upper end caps 54 and 55 are like end caps 30 and 32, preferably made of an appropriate rubber or plastic to provide some cushioning to the contact between frame links 15 and 16 and second leg frame 14.

As shown in FIGS. 1 and 2, side rails 36 and 37 of second leg frame 14 are coaxially rotatably connected at their approximate mid points by pivot pins 57 to the inside of and at the approximate mid points of side rails 46 and 47 of first leg frame 13. Left and right side rails 36 and 37 are further pivotally connected by coaxial pivot pins 58 at their upper rail portions 40 and 41 to the inside of and a short distance above the lower ends of left and right side rails 20 and 21 of back frame 12.

Further, as shown in FIGS. 1 and 2, left frame link 15 is pivotally connected at its lower end by pivot pin 61 to the inside of left side rail 46 approximately mid way between pivot pin 57 and bottom cross rail 48. Left frame link 15 is pivotally connected at its upper end by a pivot pin 62 to the inside of and at the lower end of left side rail 20. Likewise, right frame link 16 is pivotally connected at its lower end by pivot pin 59 to the inside of right side rail 47 approximately mid way between pivot pin 57 and bottom cross rail 48, and is pivotally connected at its upper end by a pivot pin 60 to the inside of and at the lower end of right side rail 21.

Pivot pins 57–62 may be comprised of any suitable device which holds one element together for rotation relative to another element. For example, pivot pins 57–62 may comprise screw and nut combinations or rivets. Pivot pins 57 are coaxial; pivot pins 58 are coaxial; pivot pins 59 and 61 are coaxial and pivot pins 60 and 62 are coaxial.

Flexible support 17 is comprised of any appropriate flexible material that will be strong enough to support a person sitting thereon. For example, the material may be a textile or a synthetic material. The material forming support 17 is essentially a band, each end of which is looped around and stitched back upon itself at 65 and 66 to form back loop 67 and seat loop 68.

Figure 4:
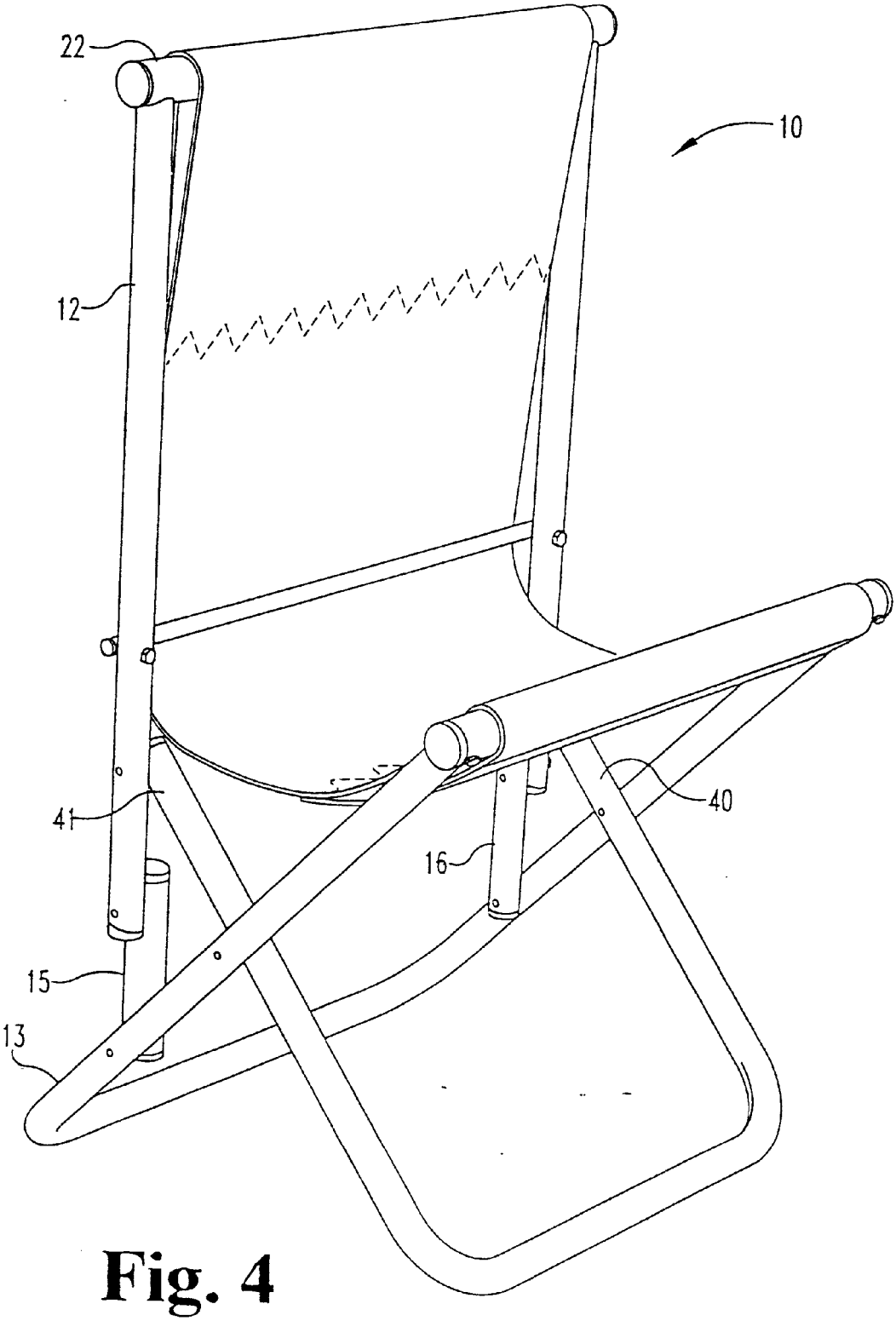
FIG. 4 is a perspective view of the folding chair 10 of FIG. 1 and shown in the mid-fold condition.

In assembly, screws 24 are removed and top cross rail 22 is separated from side rails 20 and 21. Top cross rail 22 is slid through back loop 67, and top cross rail 22 is then reconnected to side rails 20 and 21 and secured thereto with screws 24. Support 17 is passed below cross bar 28, and is similarly connected to first leg frame 13 by passing detached front cross rail 45 through seat loop 68 and then resecuring front cross rail 45 back to first leg frame 13 with screws 49. Flexible support 17 is applied to back frame 12 and leg frame 13 typically with chair 10 in the mid-fold condition shown in FIG. 4 so that there will be ample play in flexible support 17.

Top cross rail 22 and front cross rail 45 are also provided with end caps 70. End caps 27, 39, 52, 53, and 70 may be made of any material which appropriately closes off and protects the ends of the corresponding tubular or solid member. Alternative embodiments are contemplated where the tubular members would be closed off and protected from damage and protect the user from injury by means other than application of an end cap. For example, the ends could be formed in a rounded, closed-off condition, free of sharp edges. End caps 30, 31, 54, and 55 should be comprised of a material which at a minimum reduces the possibility of damage due to repeated contact between frame links 15 and 16 and leg frame 14 and between back frame 12 and first leg frame 13, when those components come in contact with each other as described herein. It is preferable that end caps 30, 31, 54, and 55 have some degree of resilience to further cushion the impact between the corresponding components. Such end caps may be comprised of a plastic or rubber material. All of the aforedescribed end caps are connected to their respective components by any appropriate means such as by screws or pressure fitting or adhesive. End caps 27, 39, 52, 53, and 70 do not need to have the same cushioning characteristics that are desired for end caps 30, 31, 54, and 55.

In use, chair 10 has an erected, rest condition as shown in FIGS. 1 and 2 whereby the angle 73 formed between first leg frame 13 and second leg frame 14 is just less than its maximum erected angle, and end caps 30 and 31 are not in contact with their corresponding leg frame 13 and end caps 54 and 55 are not in contact with their corresponding leg frame 14. In one embodiment, angle 73 in the erected, rest position is approximately 98 degrees. When a person of sufficient weight sits in chair 10 (FIG. 5), chair 10 folds to its erected, stressed condition whereby frame members 13 and 14 spread apart a few degrees further, angle 73 thereby increases to approximately 104 degrees, and end caps 30 and 31 and 54 and 55 come into contact with their corresponding and respective leg frames 13 and 14, as shown. (As used herein, "folds" or "folding" refers to the synergistic pivoting of the frames and links of chair 10 among the fully folded condition (FIG. 6), the erected, rest condition (FIG. 1) and the erected, stressed condition (FIG. 5)). Chair 10 is limited from pivoting beyond the erected, stressed condition shown in FIG. 5 by the engagement of frame links 15 and 16 against the underside of second leg frame 14 and the engagement of the lower ends of side rails 20 and 21 against side rails 46 and 47, respectively. The particular dimensions of the frames and links of chair 10 are chosen in connection with the length of flexible support 17 from loop 67 to loop 68, and in connection with the location of cross bar 28 secured to back frame 12, so that flexible support 17 will be very taut from top cross rail 22, passing below cross bar 28, and to front cross rail 45 when chair 10 is in the erected, stressed condition. Thus, when the person rises from seat 10, the tension of flexible support 17 pulls seat 10 back from the erected, stressed condition (FIG. 5) to the erected, rest condition (FIG. 1). Seat 10 may then be folded from the erected, rest condition (FIG. 1) by pulling front cross rail 45 towards top cross rail 22, whereby the components of chair 10 pivot relative to each other through the mid-fold condition (FIG. 4) and ultimately to the collapsed condition as shown in FIG. 6. In the collapsed condition (FIG. 6), the components (frames 12–14 and links 15 and 16) have assumed a stacked configuration that is only slightly taller than the tallest component (e.g. back frame 12 or second leg frame 14) and is very narrow, as well. This makes chair 10 convenient to store and transport.

The present invention contemplates that the angle 73 formed between first and second leg frames 13 and 14 about pivot pins 57 preferably in the erected, rest condition (FIG. 1) be about 98 degrees and in the collapsed condition (FIG. 6) be about 10 degrees. However, these angles 73 may vary with the particular dimensions of the various components of chair 10 and with the particular pivotal connection locations of the various components of chair 10.

Alternate embodiments are contemplated wherein second leg frame 14 and frame links 15 and 16 are pivotally secured to the outside of, instead of to the inside of, back frame 12 and first leg frame 13.

Figure 8:
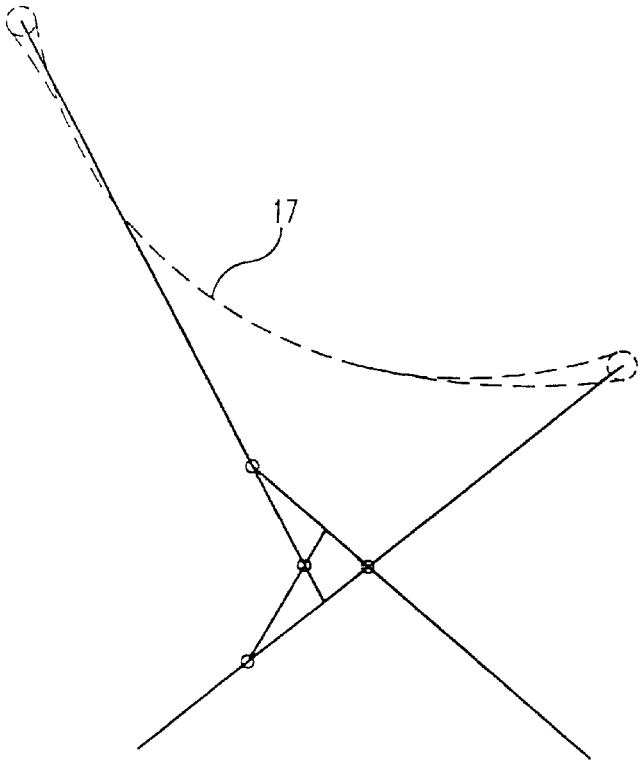
FIG. 8 is a side elevational view of an alternative embodiment of the present invention.
Figure 7:
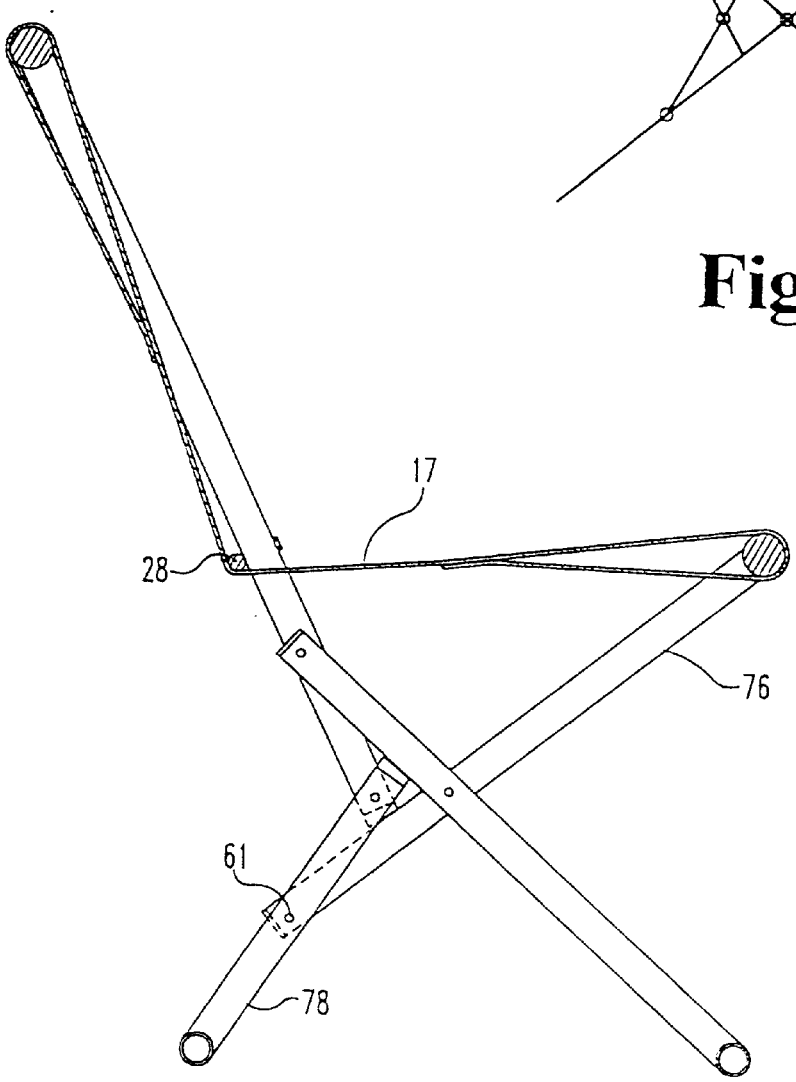
FIG. 7 is a side elevational view of an alternative embodiment of the present invention.

FIGS. 7–10 show alternative embodiments contemplated by the present invention. Referring to FIGS. 2 and 7, first leg frame 13 is essentially shortened with its lower portion removed up to pivot pin 61 to form a generally U-shaped member 76, and left and right frame links 15 and 16 are extended down to the ground and into a U-shaped member 78. FIG. 8 shows diagrammatically the embodiment of FIG. 2 but with flexible support 17 shown in a sling configuration without the use of horizontal crossbar 28.

Figure 9:
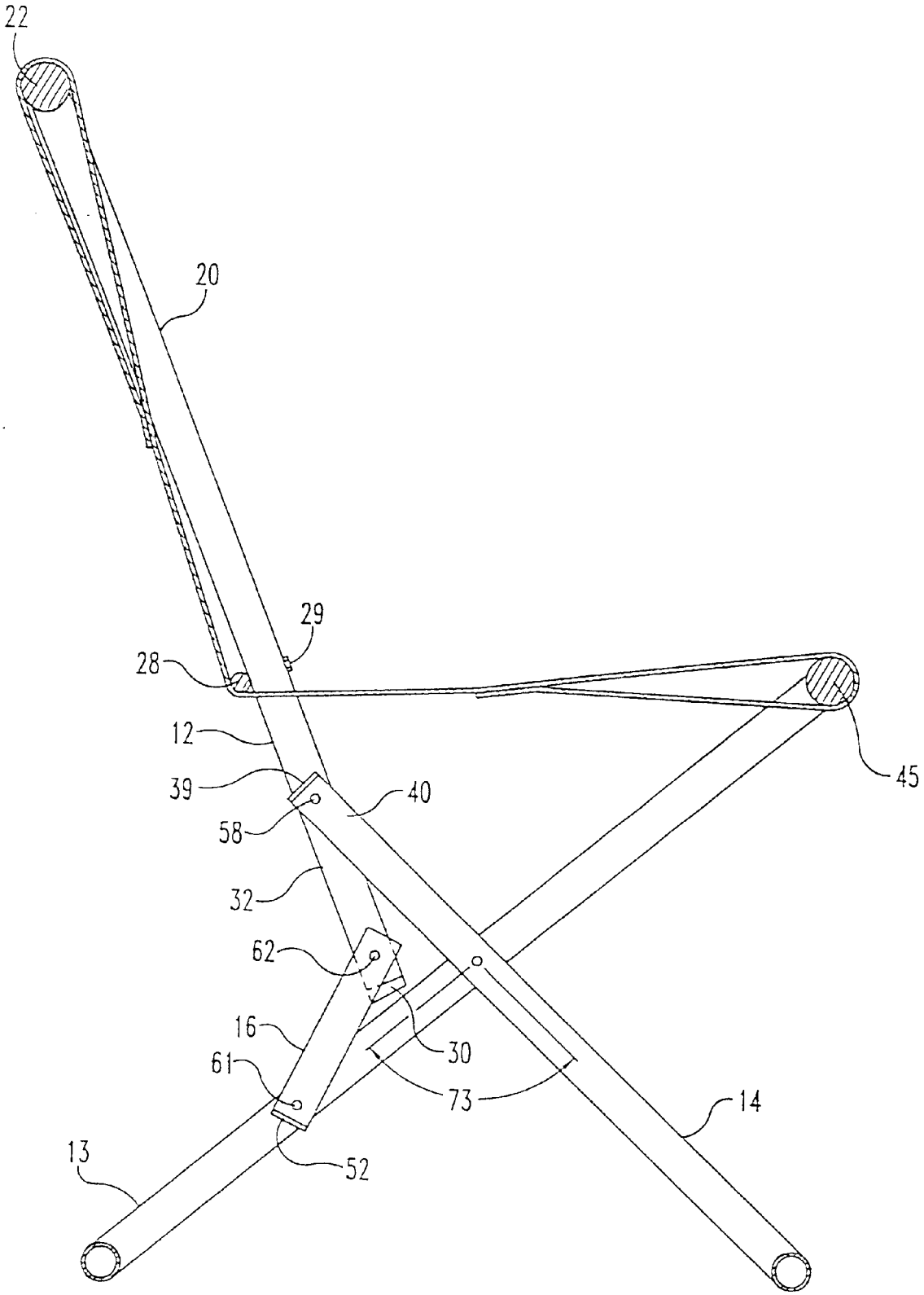
FIG. 9 is a side elevational view of an alternative embodiment of the present invention.
Figure 10:
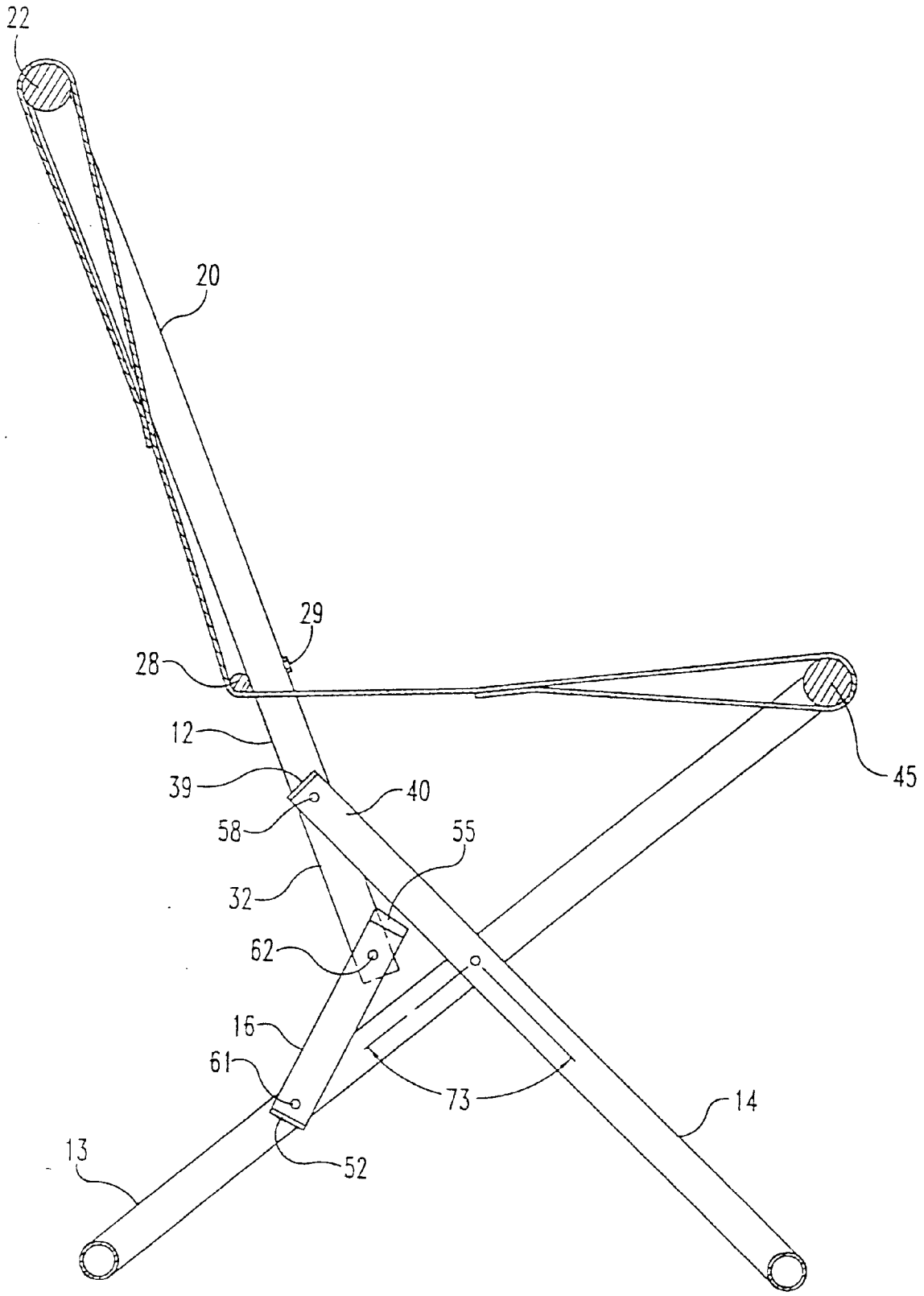
FIG. 10 is a side elevational view of an alternative embodiment of the present invention.

FIGS. 9 and 10 show alternative embodiments where only one pair of stop members is used to define the opening limits of chair 10. That is, referring to FIG. 9, only back frame 12 is extended far enough below pivot pins 60 and 62 to engage with first leg frame 13 to define the opening limit of chair 10 at the erected, stressed condition. The upper portion of left and right frame links 15 and 16 are shortened and do not engage with second leg frame 14. Likewise in FIG. 10, only left and right frame links 15 and 16 engage with second leg frame 14 to define the opening limit of chair 10 and the lower portions of back frame 12 are shortened and do not engage with first leg frame 13.

Back frame 12 has been described as a three piece unit. Alternative embodiments are contemplated wherein back frame 12 is a single-piece, U-shaped frame, similar to second leg frame 14, or is yet another configuration or construction that is pivotally connected, as described herein, to leg frame 14 and frame links 15 and 16. In such case, flexible support 17 may be made the same, which would make removal/repair thereof difficult; or flexible support 17 may be made in an alternative configuration, facilitating its removal from back frame 12 without disassembling any of the frame elements of chair 10. For example, but in no way limiting, support 17 may be connected with either or both top and front cross rails 22 and 45, respectively, by appropriate connectors such as snaps, wires, chains, ropes, or any other device that sufficiently securely connects support 17 to cross rails 22 and 45 and permits its ready detachment, as desired. Likewise, the present invention contemplates leg frames 13 and 14 being of alternative constructions comprising one, two, three or more components.

It is further contemplated that frame links 15 and 16 could comprise a single frame link having a U-shaped, box-shaped, or other appropriate configuration, but still pivotally connecting the left and right side rails of the second leg frame with the corresponding left and right side rails of the lower back frame, as described herein.

Figure 5:
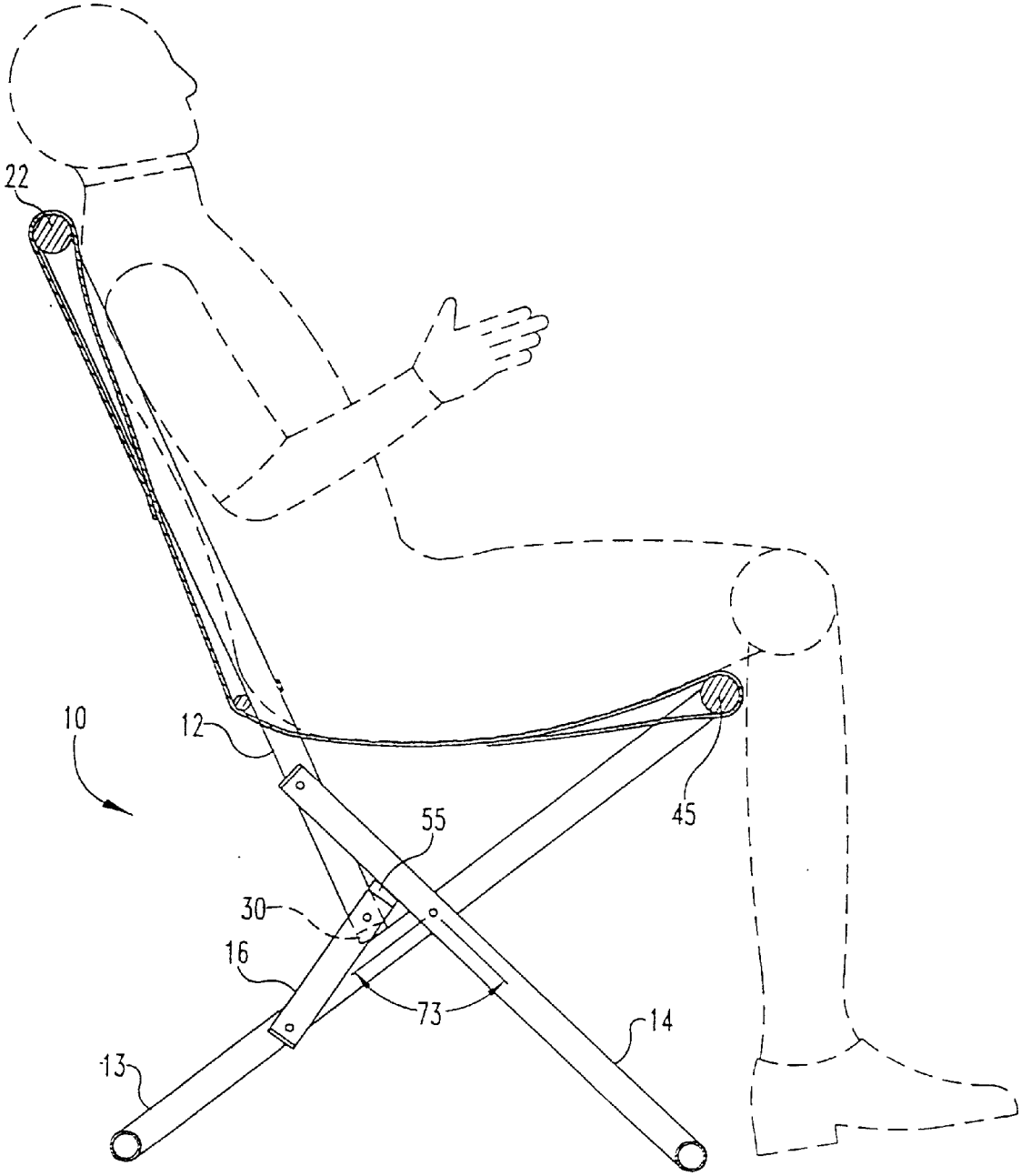
FIG. 5 is a side cross sectional view of the chair 10 of FIG. 2 shown stressed to the erected, stressed condition as a result of a person sitting therein.
Figure 6:
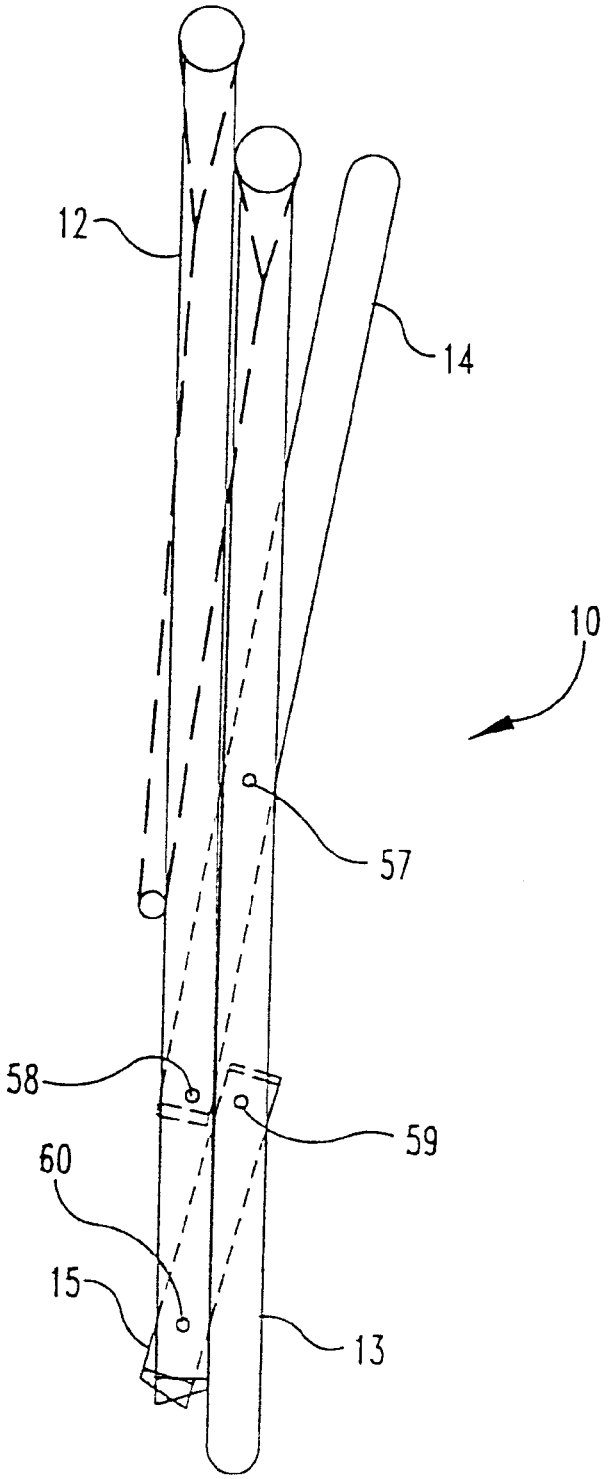
FIG. 6 is a side elevational view of the folding chair 10 of FIG. 1 and shown in the collapsed condition.

The present invention further contemplates a construction of chair 10 where chair 10 is folded directly to a fully erected condition wherein end caps 30 and 31 and 54 and 55 are engaged with their corresponding and respective leg frame 13 and 14, as shown in FIG. 5. That is, the fully erected condition is achieved without the need for a person to sit in chair 10, but simply by folding chair 10 thereto.

While the invention has been described in detail in the foregoing description, the same is to be considered as illustrative and not restrictive in character, it being understood that only the preferred embodiments have been shown and described, and that all changes and modifications that come within the spirit of the invention are desired to be protected.

What is claimed is:

1. A chair, comprising:

a first leg frame having opposing left and right side rails and a front cross rail extending therebetween, the side rails each having upper and lower ends and left and right axes;

a second leg frame having opposing left and right side rails and at least one cross rail extending therebetween, the side rails of said second leg frame each having upper and lower ends and left and right axes;

a back frame having opposing left and right side rails and a top cross rail extending therebetween, the side rails of said back frame each having upper and lower ends and left and right axes;

left and right frame links each having upper and lower ends and an axis;

a flexible support member extending between the top cross rail and the front cross rail;

wherein the left and right side rails of said second leg frame are pivotally connected along a first pivot axis to the respective left and right side rails of said back frame and are pivotally connected along a second pivot axis to the respective left and right side rails of said first leg frame, wherein said left and right frame links are pivotally connected along a third pivot axis to the respective left and right side rails of said back frame and are pivotally connected along a fourth pivot axis to the respective left and right side rails of said first leg frame, and wherein said chair may be folded between an erected, rest condition and a collapsed condition; and, wherein the left axes of said first leg frame and said back frame are substantially coplanar and the right axes of said first leg frame and said back frame are substantially coplanar and the left axis of said second leg frame and the axis of said left frame link are substantially coplanar and the right axis of said second leg frame and the axis of said right frame link are substantially coplanar.

* * * * *